United States Patent [19]

Isakson

[11] 4,378,722

[45] Apr. 5, 1983

[54] MAGNETIC PICKUP FOR STRINGED MUSICAL INSTRUMENTS

[76] Inventor: David A. Isakson, 24618 Nameless La., Fort Bragg, Calif. 95437

[21] Appl. No.: 310,223

[22] Filed: Oct. 9, 1981

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,263,973 | 11/1941 | O'Brien | 84/1.15 |
| 2,455,575 | 12/1948 | Fender et al. | 84/1.15 |
| 3,249,677 | 5/1966 | Burns et al. | 84/1.16 |
| 3,571,483 | 3/1971 | Davidson | 84/1.16 |
| 3,715,446 | 2/1973 | Kosinski | 84/1.15 |
| 3,983,778 | 10/1976 | Bartolini | 84/1.15 |
| 4,026,178 | 5/1977 | Fuller | 84/1.16 |
| 4,133,243 | 1/1979 | DiMarzio | 84/1.15 |
| 4,261,240 | 4/1981 | Aaroe | 84/1.15 |
| 4,283,982 | 8/1981 | Armstrong | 84/1.15 |
| 4,320,681 | 3/1982 | Altilio | 84/1.15 |

*Primary Examiner*—S. J. Witkowski

[57] ABSTRACT

An improved pickup system for stringed musical instruments, adaptable to all types of stringed instruments, in which strings pass through the hollow central portion of coils and the magnetic field within coil windings is perpendicular to the windings and parallel to the string axes. The described embodiments include an individual coil encompassing each string and a magnetic field reversed in polarity in portions of a coil oppositely disposed to a string. Magnetic elements provide an enclosed magnetic field limiting pickup response to a short, defined segment of string near an instrument's bridge. Described acoustic pickup embodiments are mounted directly to the bridge and interrupt the circle of acoustic feedback. Violin family pickup embodiments provide preferential sensing of string motions parallel to the string plane and adjustability of string response. The pickup system is designed to provide efficient and precise translation of string harmonic motions and thus reproduce the overall tonal characteristics of a stringed musical instrument.

15 Claims, 10 Drawing Figures

MAGNETIC PICKUP FOR STRINGED MUSICAL INSTRUMENTS

BACKGROUND OF THE INVENTION

1. Field of the Invention

Stringed musical instrument pickups which provide an electrical signal corresponding to the sound-producing vibrations of a musical instrument by sensing the motions of strings and translating string motions into an electrical signal.

2. Discussion of Prior Art

A primary object of stringed instrument pickup innovation has been to provide a capability of accurately reproducing the entire harmonic spectrum or "voice," of a particular musical instrument. The overall vibrational characteristics of a particular instrument directly and simultaneously influence the relative amplitudes of a string's harmonics and therefore an accurate representation of an instrument's voice can be obtained by sensing only string motions of the particular instrument. However there are many obstacles to achieving this goal, many of which have not been adequately addressed by prior art.

A major consideration which has often been overlooked is that a string's harmonic nodes, and loops located halfway between the nodes, are formed at all equal divisions of string length. Since the harmonic segments overlap each other and change when string length is changed during playing of the instrument, it follows that sensing string motion at a given intermediate location may represent a given harmonic at its loop, or maximum displacement, or at the node where no motion takes place, or anywhere between. Accurate harmonic representation then will not be achieved.

However, since an instrument's bridge serves as a node for the fundamental and all subsequent harmonics it is possible to achieve very accurate representation of all string motions, and hence an instrument's tone, or voice, by sensing string motion at a point close to the bridge. The inherent distortion at such a point is largely an addition of emphasis to succeedingly higher harmonics. This is because the fundamental and lower harmonics will be sensed relatively near their nodes while the higher harmonics will be sensed closer to their loops. This progressive emphasis of higher harmonics can be beneficial to a degree since many components of a pickup and subsequent electronic parts provide the opposite effect of attenuating high frequencies. The curve of succeeding harmonic emphasis is also close to the reverse of the curve of attenuation of simple resistor and capacitor tone controls and therefore additional signal compensation, to resolve the signal to accurate representation, can be easily achieved.

Prior art pickups, however, have not been able to take full advantage of near to bridge locations. One problem inherent in almost all pickups is that they have a largely "open" magnetic field, or one that diminishes along a string only as the square of the distance from the magnetic field source. In this case conflicting motions of a given harmonic may simultaneously be registered in the pickup coil, even arbitrarily cancelling certain harmonics, and so only very "fuzzy" harmonic representation can be achieved and the advantages of a near bridge location are largely lost. Another problem is that only very slight motions of the strings are available near the bridge to act on the pickup components and much of this energy is in the form of high harmonics which are subsequently attenuated. This places the additional requirement, then, that the pickup must be extremely efficient.

Sensitivity to string motion can be increased when the strings pass through the hollow center of a coil, particularly when an individual coil is provided to each string, or in the case of double-strung instruments such as mandolin, to each pair of strings. Prior art in U.S. Pat. Nos. 3,249,677 (Burns), 3,571,483 (Davidson), 3,715,446 (Kosinski), and 3,983,778 (Bartolini), recognize and explain the advantages of providing individual coils to each string. Some of these are: lower impedance, higher resonant frequency, and the possibility of individual treatment of the signal from each string. U.S. Pat. Nos. 2,263,973 (O'Brien), and 2,455,575 (Fender), utilize an elongated coil surrounding an instrument's strings and the latter invention of channel shaped pole pieces also describes an embodiment which provides a separate coil surrounding each string.

But the impedance, capacitance and resonant frequency problems with large coils are destructive of both signal quality and efficiency. And the efficiency requirements with individual coils are great since string spacing often places severe restrictions on maximum outside coil diameter and where the string passes through the coil the inside diameter must be large enough to accommodate string displacements for any type of playing. While there have been many innovations and improvements in pickup design, none of the prior art configurations of magnet and coil pickups are capable of meeting the highly demanding requirements and considerations of fully representing the harmonic spectrum of a stringed musical instrument. The harmonic richness present in the string vibrations of even solid body electric instruments has therefore not previously been made available to musicians. Better reproduction of the tone of acoustic instruments has generally been achieved by sensing vibrational motions of an instrument's top, such as with bridge mounted transducers, or with microphones. These methods, however, have significant inherent problems. Transducer pickups have a very high ambient electrical noise to signal ratio, even when close-to-source preamplification is provided, as well as a tendency to "roll off" high frequencies. A significant problem associated with all such methods is the tendency to acoustic feedback. In this feedback circle sound waves from the speaker return to the instrument's large vibrating surface top and cause an increase in the amplitude of the top's vibrations. This increase is then registered by the pickup causing a stronger signal, and stronger sound waves, repeating the circle and so on. The result is a loud "booming" or other unwanted sounds when a string is plucked. This problem is particularly severe in performance situations where the volume level must be high enough to be heard along with other instruments and in many cases the harmonic richness of an acoustic instrument has been excluded as a possibility to musicians because of this universal problem.

SUMMARY OF THE INVENTION

Some of the objects of my invention are therefore to provide complete, accurate and consistent representation of the full audible harmonic spectrum of an instrument and to provide such representation of acoustic instruments without a significant potential for acoustic feedback. If "aperture" is considered to be the length of string to which a pickup is sensitive then a further object is to provide a pickup with a small and well defined aperture in order to avoid including conflicting motions of higher harmonic segments of string vibration, and to provide adequate signal strength where a small aperture is employed and the pickup is mounted in close proximity to the bridge of a musical instrument. To this end the invented pickup configuration has a magnetic field which is virtually enclosed, or contained within the pickup structure. In this way all of the magnetic field supplied by the permanent magnets is available to react to string motions and activate coil windings. In this sense it is important that the direction of wires relative to magnetic field direction and also distribution of the magnetic field to both string and coil windings are considered. The invention contains the magnetic field geometry relative to strings and coil windings necessary to achieve optimal efficiency and accuracy in translation of string motions into electrical impulses. Optimal efficiency is obtained since the direction of wires in affected segments of coil windings is substantially perpendicular to the direction of the magnetic field within them and the direction of motion of the magnetic field is also perpendicular to the axes of the coil wires at two opposite points in a string's elliptical oscillation. Previous pickup inventions have tended to consider only the reluctance of the magnetic circuit in considerations of efficiency. However, it should also be considered that motions of the magnetic field which are parallel to the coil wires will produce no signal and any motions where the direction of the magnetic field is parallel to the coil will produce no signal regardless of the reluctance of the magnetic circuit. Conversely, maximum efficiency within a given flux gradient will be achieved when both the relative angular orientation and direction of motion of the magnetic field are perpendicular to the direction of the wires.

Another aspect contributing to the high degree of efficiency in the invented pickup is the focusing and "locking" of the magnetic field within a string segment, thus optimizing reaction of the magnetic field to string motion. By successfully addressing all the above consideration my invention provides design potentials and potential for applications which have previously been unavailable. A relatively small amount of applied magnetic field strength is necessary allowing the use of less expensive and easily workable types of magnets such as the commonly available plastic magnet material. At the same time the number of turns of coil wire required to produce an adequate signal strength is reduced. This allows the use of coils small enough to meet the most demanding spatial limitations, and where a single elongated coil is employed the number of turns can be reduced to the point of eliminating most of the objectionable features of such coils.

In embodiments of the invention which utilize a magnetic field with reversed polarity in two opposing sections of coil windings the combined efficiencies described above are again doubled. This is because the portions of wire in one side of a coil are inherently reversed in direction from portions on the other side. Since transverse string motions will move the magnetic field simultaneously in the same direction in both portions of coil windings it follows that reversing the direction of polarity will provide electrical impulses in opposing portions which are additive, thus doubling the output signal strength.

Pickups can be designed by this invention, then, that are extremely small in dimension and mass relative to prior art configurations. The pickup unit can be made very narrow in profile and the magnetic field is then enclosed on a short segment of string, providing ideal conditions for accurate sensing of string motions. Surrounding the strings with a coil also contributes to accurate representation. Every change in angle and amplitude of a string segment's motion will be registered and translated into a symmetrical electrical wave form. Because of the above considerations pickup embodiments may be designed for use on instruments which have previously not been able to effectively utilize magnetic pickups. Pickup embodiments can be mounted directly to the bridge of violins, mandolins, guitars and other acoustic instruments. As such the pickup's mass can be small enough to cause no appreciable muting or loss of tone of the instrument. Accurate reproduction of harmonics and thus faithful representation of the instrument's voice is then provided without the impedance, high frequency attenuation and other problems of pickup devices which are available for these instruments. Perhaps the most significant aspect of this type of embodiment however is that acoustic feedback is virtually eliminated. Since the pickup is not directly sensitive to motions of the instrument's top, but only to string vibrations an effective break in the circle of feedback is provided. The tendency to feedback is then replaced with, at most, a tendency to sustain string vibration. The above discussion outlines some of the features and advantages of my invention over prior art. Further features and advantages will become apparent upon consideration of the following detailed description of the preferred embodiments.

DESCRIPTION OF PREFERRED EMBODIMENTS

Figure 1:
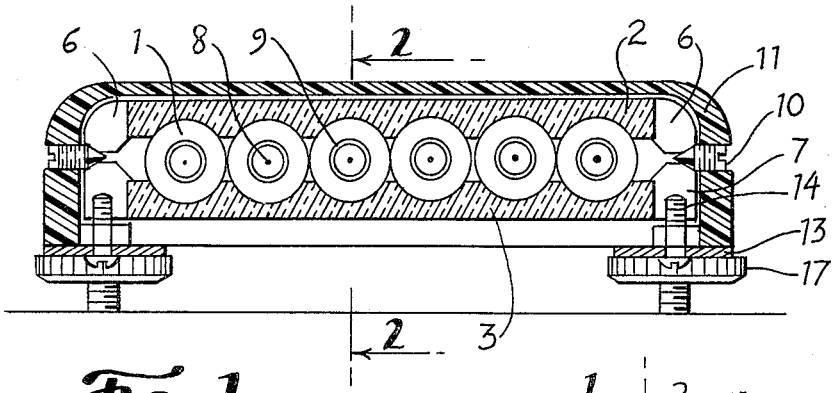
FIG. 1 is a section taken at line 1—1 of FIG. 2, sighted along the string plane and toward the bridge, of a preferred electric guitar pickup embodiment mounted to a standard adjustable bridge.
Figure 2:
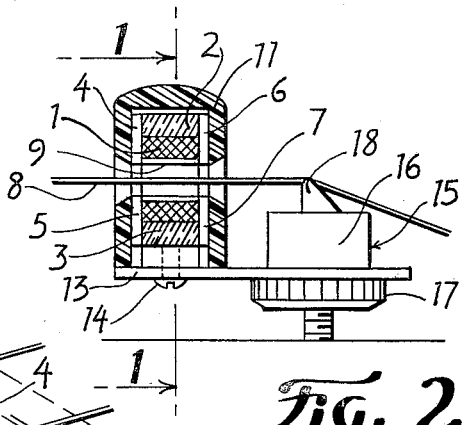
FIG. 2 is a section of the pickup of FIG. 1, taken at line 2—2 of FIG. 1 and sighted across the string plane.
Figure 3:
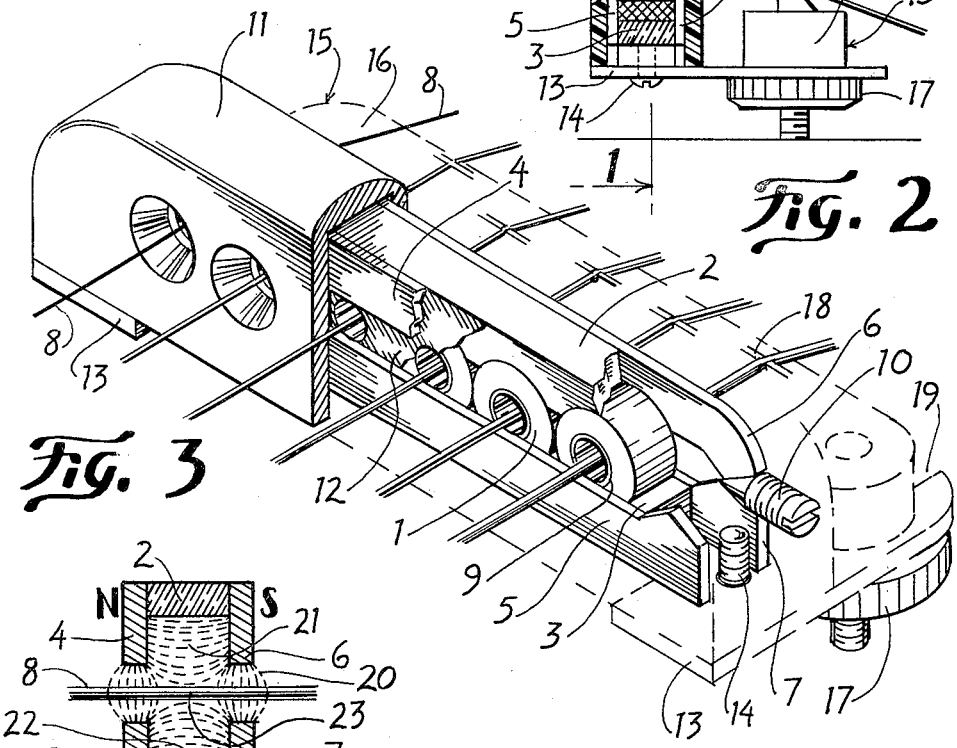
FIG. 3 is a progressive cutaway isometric view of the preferred pickup embodiment of FIGS. 1 and 2.

Referring to FIGS. 1, 2, and 3, the basic components of a preferred embodiment electric guitar pickup system are the six coils 1, the upper and lower permanent magnets 2 and 3 respectively, and the pole piece strips 4, 5, 6, and 7, including a pole piece 4 disposed to the front surface of the upper permanent magnet 2, a pole piece 5 disposed to the front surface of the lower permanent magnet 3, a pole piece 6 disposed to the back surface of the upper permanent magnet 2, and a pole piece 7 disposed to the back surface of the lower permanent magnet 3. Additional active components of the pickup system are the six strings 8 which pass through the hollow central portion of the coils 1 and their protective armature tubes 9. The pole pieces 4, 5, 6, and 7, each have two end portions angled to fit the conical end portions of screws 10 which are threaded into the pickup housing 11, for adjusting the distance between upper and lower pole pieces 4 and 5, and similarly between pole pieces 6 and 7. For example, backing out a screw 10 will lessen the distance between the two associated pole piece ends and hence also their distance from the strings 8. The decrease in distance will be greater toward the end of the string plane of an adjusting screw 10, and will increase the output signal strength from strings 8 according to the decrease in distance from pole piece 4, 5, 6, and 7, inner edges.

Each coil 1 fits within shaped portions of both upper and lower permanent magnets 2 and 3. A film of protective material 12 separates the coil 1 end faces from the pole pieces 4, 5, 6, and 7. Mounting plates 13 are attached to the pickup housing 11 by screws 14 and to a standard adjustable bridge unit 15. The mounting plates 13 are clamped between the body of the bridge 16 and the height adjusting thumbscrews 17 by pressure exerted by the strings 8 on the adjustable saddles 18. The mounting plates 13 can also be provided with a slot at 19 allowing adjustment of the distance between the pickup housing 11 and the bridge unit 15. In this way automatic alignment of the height of the strings 8 within the coil armature tubes 9 is provided.

Figure 4:
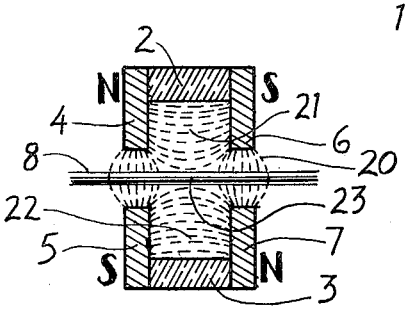
FIG. 4 is a diagrammatic section of a pickup embodiment similar in section to line 2—2 of FIG. 1, showing only the magnetic elements and magnetic field of a pickup embodiment.

Referring now to FIG. 4, broken lines 20 show the direction of the magnetic field at given points within a pickup structure, as provided by the upper and lower permanent magnets 2 and 3, and carried by the pole pieces 4, 5, 6, and 7. The letters "N" and "S" indicate the North and South polarity of adjacent parts. For purposes of clarity coil 1 windings are omitted from this diagram. However it can be seen that windings would be housed in an upper sector 21 and a lower sector 22 of the pickup structure (see FIG. 2). A linear segment 23 of a string 8 passes between the two sectors 21 and 22. The length of the linear string segment 23 is equal to the effective extent of the magnetic field as shown by broken lines 20 and is equal to the "aperture" of the pickup. Where non magnetically susceptible strings are employed the addition of a layer of magnetically susceptible material to the linear string segment 23 will enable the string 8 vibrations to activate the magnetic field. For purposes of this disclosure the term "magnetically susceptible" includes any material that will concentrate magnetic lines of force, while "magnetic" or "magnetically active" includes the above materials as well as "permanent magnet" materials which are magnetized.

It can be seen that the overall magnetic field direction within the coil sectors 21 and 22 is parallel to the string 8 axis. The direction of the wires is opposite within the two sectors 21 and 22, meaning that the electrically grounded end of the wires would be facing the reader in one sector, as 21, and pointing away from the reader in the other sector, as 22. The directional opposition is usually due to the two coil sections being opposite sides of the same coil, as is the case with the previous and subsequently described embodiments. Since an upward motion of the string segment 23 will cause corresponding upward motions of the magnetic field within both coil sectors 21 and 22, the reversed polarity in the two sections will cause an electrical impulse which is opposite within the two sectors 21 and 22 and hence the same relative to the overall direction of the wires. In this way the impulses generated in the two coil sections are additive. If the upward motion causes a positive impulse at the positive coil lead a downward motion will cause a negative impulse at the positive coil lead. String segment 23 motions which are perpendicular to the section plane of the diagram will cause little or no signal because of the absence of magnetic flux gradient in this direction. The transverse eliptical motions of the vibrating string 8 then cause a balanced electrical wave form with a wide sweep from positive to negative which closely follows every change in angle and amplitude of the string segment 23 vibrational motions.

The enclosed nature of the magnetic field is also clearly illustrated by this diagram. The broken lines 20 show that four preferential paths are provided to the magnetic field. Two of these paths are between upper front pole piece 4 and upper back pole piece 6, and similarly between lower front pole piece 5 and lower back pole piece 7. These paths supply the magnetic field to the two coil sectors 21 and 22. The other two paths are between upper front pole piece 4 and lower front pole piece 5, and similarly between upper back pole piece 6 and lower back pole piece 7, and supply the magnetic field to the string segment 23. As a result only a very slight residual magnetic field will be evident at exterior surfaces of the pole pieces 4, 5, 6, and 7 and the permanent magnets 2 and 3, virtually all of the magnetic circuits being contained within the pickup structure, and within a discrete segment 23 of string 8.

The efficiency of the configuration can actually be increased by lessening the distance between the front pole pieces 4 and 5 and the back pole pieces 6 and 7, i.e., by making the pickup narrower, since this provides a shorter path for the magnetic field within the coil sectors 21 and 22. The loss of coil space is thus somewhat compensated by the increased magnetic field concentration within the coil windings. This also decreases the length of string segment 23 providing a smaller aperture. While the embodiments of this invention are generally designed for mounting near an instrument's bridge it will usually be found that optimal response is obtained when the aperture is located a small distance from the bridge. Distortions begin to occur due to conflicting string segment 23 motions when a harmonic segment is shorter than the pickup aperture and when the distance of the aperture from the bridge is greater than the length of the harmonic segment. Pickups of this invention can be designed so that the aperture approximates the length of the highest audible harmonic segment and thus complete and accurate representation of the audible frequency spectrum of string vibration is achieved.

Figure 5:
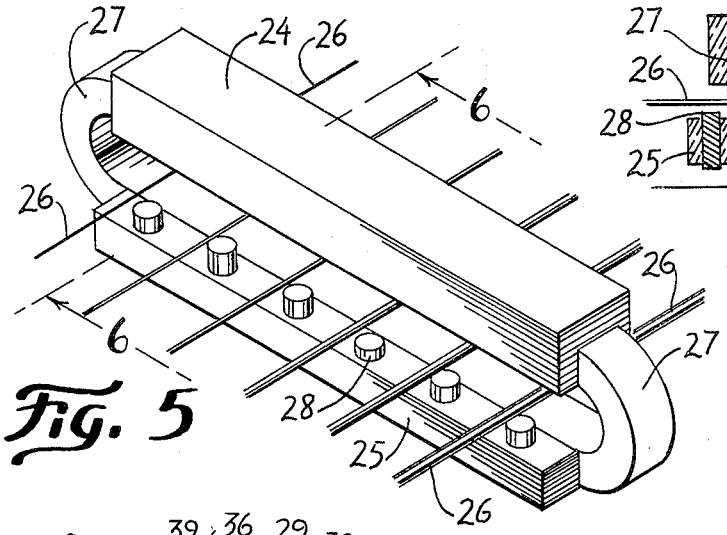
FIG. 5 is an isometric view of a preferred embodiment utilizing a single coil and a combination of magnetic structures, with no housing shown.
Figure 6:
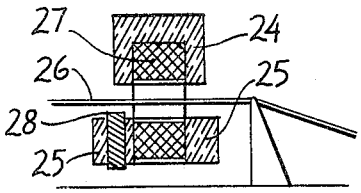
FIG. 6 is a section of the pickup of FIG. 5, taken at line 6—6 of FIG. 5, and sighted across the string plane of an instrument.

Referring now to FIGS. 5 and 6, different types of magnetic structures are provided above 24 and below 25 the string plane. This preferred embodiment illustrates the diversity of design combinations that are possible by this invention. The upper magnetic structure 24 is formed of a single permanent magnet having a direction of polar orientation parallel to the string 26 axes. A "U" shape is formed housing an upper section of the coil 27. The leg portions of the "U" are equivalent to the pole piece strips of other described embodiments and in this sense it should be noted that any "pole pieces" of this invention may be made of permanent magnet as well as magnetically susceptible material. The lower magnetic structure 25 has permanent magnets disposed to each end only of the coil 27 windings. Again, the direction of polar orientation is parallel to the string 26 axes and is reversed from that of the upper magnetic structure 24. Adjustable cylindrical pole piece elements 28 are disposed below and proximate to each string 26. These may be threaded into the permanent magnet 25 or simply push fit into flexible plastic magnet material. Adjustments of the distance of each pole piece 28 from a respective string 26 provides individual adjustment of string 26 response. For purposes of clarity, means for housing the pickup embodiment to a musical instrument are not shown, but are assumed.

Figure 7:
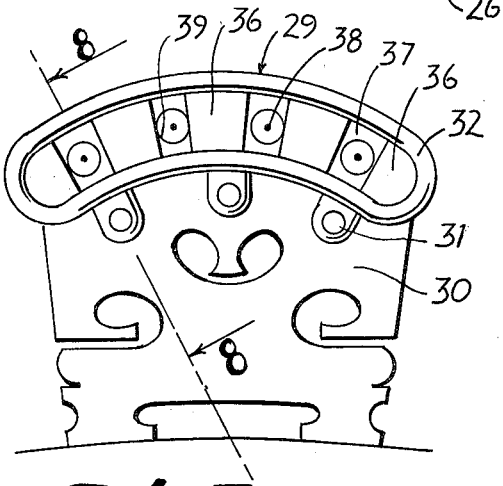
FIG. 7 is a frontal view of a preferred embodiment pickup mounted to a standard violin bridge.
Figure 8:
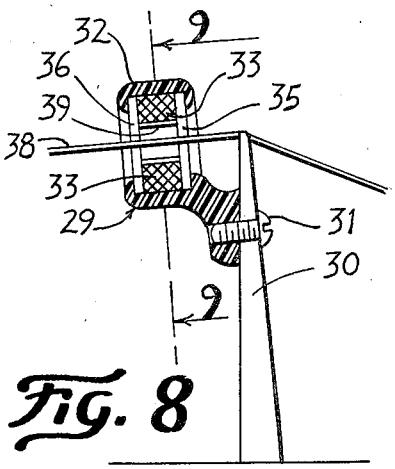
FIG. 8 is a section of the pickup of FIG. 7, taken at line 8—8 of FIG. 7, and sighted across the string plane.
Figure 9:
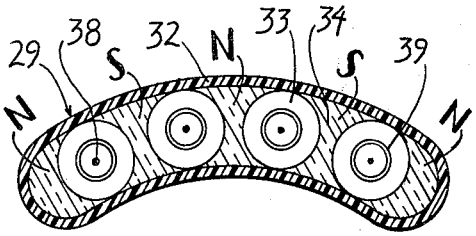
FIG. 9 is another section of the pickup of FIG. 7, taken at line 9—9 of FIG. 8, and sighted along the string plane.

Referring now to FIGS. 7, 8, and 9, the preferred embodiment pickup unit 29 is adapted for mounting to a standard violin bridge 30 by three screws 31. The pickup housing 32 material in this embodiment is formed of flexible plastic to accommodate variations of the curvature of the string plane which may be preferred for different instruments. The pickup unit 29 is simply bent to the desired curvature and appropriately positioned holes are drilled in the bridge 30. The proper curvature will be maintained by the mounting screws 31. The coils 33 fit within shaped portions of the permanent magnet elements 34. In this embodiment of the invention it can be seen that the permanent magnets 34 are disposed between the coils 33. The letters "N" and "S" indicate the polarity of the magnets facing the reader, the direction of the magnetic field being substantially parallel to the string 38 axes. In embodiments designed for use on instruments that might be played with a bow it is important that the magnetic elements are disposed to produce maximum response to string motions that are tangent to the curved string plane. While a plucked string will vibrate in an ellipse containing substantial motions in every transverse direction, a bowed string vibrates mostly only in a direction parallel to movement of the bow.

Pole pieces at the back 35 and front 36 ends of coils 33 are gripped by portions of the flexible housing 32 and can be moved from side to side in order to balance relative string response. A protective film 37 is provided between the coil 33 faces and the pole pieces 35, 36. The instrument's magnetically active or activated strings 38 pass through the center of armature tubes 39. In this and all other described embodiments of the invention it is assumed that coils are adapted for electrical connection, individually or in combination, to appropriate preamplification and amplification devices, series wiring being generally preferred for multiple coils.

Figure 10:
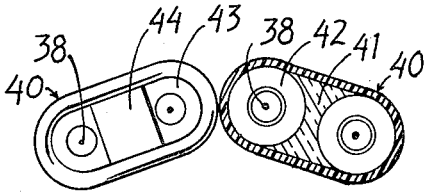
FIG. 10 shows a preferred pickup embodiment for violin family instruments constructed in two parts. The part on the left of the figure is shown in frontal view, the part on the right is an identical unit shown in section perpendicular to the string plane.

Referring now to FIG. 10, provision for different string plane curvatures of violin family instruments is accomplished by constructing the pickup in two separate units 40. In this preferred embodiment each unit 40 has a single internal permanent magnet 41 between two coils 42. A protective film 43 is provided between the coil 42 faces and the pole pieces 44. Front and back pole pieces 44 are provided as in the embodiment of FIGS. 7, 8, and 9. Suitable means for mounting the pickup units 40 to the bridges of violin family instruments is assumed. This embodiment illustrates the provision of a magnetic field to one side only of a coil 42. As with all other embodiments of this invention the direction of the magnetic field is parallel to string 38 axes.

The above description includes several preferred embodiments representative of the invention. However, many other general and specific variations are possible. For example, magnetic material, permanently magnetized and magnetically conductive, can be provided in diverse shapes and combinations in order to meet or enhance specific design criteria. In double-strung instruments such as mandolin, pairs of strings can pass through individual coils; coils could be wound on other than cylindrical armatures for improving spatial and response characteristics. Other possibilities include individually mounted and/or adjustable coil assemblies for each string, integrally constructed pickup and bridge assemblies, built-in high frequency attenuation devices, etc. The scope of the invention, then, should be determined not only by the above description but also as legally indicated by the appended claims.

What I claim is:

1. In devices for sensing vibrational motions of tuned strings and producing thereby an electrical signal corresponding to the relative harmonic emphasis of a stringed musical instrument, a magnetic pickup comprised of:

a. coil windings of insulative conductive wire, b. a magnetically susceptible linear string segment of each string of a musical instrument, c. magnetic means for providing a magnetic field within each said linear string segment and portions of said coil windings, wherein portions of a coil are disposed proximate each said linear string segment, two said portions of a coil being oppositely disposed to the axis of each said linear string segment, the axes of the coil wires in each said oppositely disposed portion of coil being substantially perpendicular to the axis of the proximate said linear string segment, said magnetic means providing a magnetic field within a portion of coil windings disposed proximate each said linear string segment, the overall north to south direction of said magnetic field within each said portion of coil windings being substantially parallel to the axis of the proximate said linear string segment and perpendicular to the axes of the coil wires in said portions of coil windings, whereby magnetic "lines of force" are disposed perpendicularly to and caused to move perpendicularly through said proximately disposed coil wires at two opposite points in each elliptical oscillation of a vibrating said linear string segment, angular motions at one said point on the ellipse causing a peak positive impulse at a coil lead while motions at the opposite point cause a peak negative impulse at the same said coil lead and the remaining composite of angular motions complete the translation of elliptical motion to a linear electrical wave form, said magnetic pickup further including means for stably positioning said coil windings and said magnetic means relative to the quiescent axes of said linear string segments of said musical instrument, and means for electrically connecting the leads of said coil windings to appropriate signal preamplification and amplification devices.

2. The magnetic pickup of claim 1 wherein said magnetic means includes magnetically active material, portions of said magnetically active material being permanent magnet material, portions of said coil windings proximate each said linear string segment being disposed between a respective said linear string segment and portions of said permanent magnet material, said permanent magnet material having north and south polar end faces with a resultant overall north to south line of polar orientation substantially parallel to the axis of the proximate said linear string segment.

3. The magnetic pickup of claim 1 wherein said magnetic means includes magnetically active material, portions of said magnetically active material being permanent magnet material, a said portion of coil windings being disposed between two confronting portions of said magnetically active material, same said portion of coil windings and said two portions of magnetically active material being disposed proximate and to the same side of a said linear string segment, said two confronting portions of magnetically active material having a magnetic field direction substantially parallel to the proximate said linear string segment and having substantially the same north to south direction of polarity.

4. The magnetic pickup of claim 1 wherein said magnetic means includes magnetically active material, portions of said magnetically active material being permanent magnet material, two confronting portions of said magnetically active material being disposed proximate and to opposite sides of a said linear string segment and proximate two end surfaces of said coil windings, said two portions of magnetically active material having opposite direction of polarity and a magnetic field direction substantially parallel to the proximate said linear string segment axis.

5. The magnetic pickup of claim 1 wherein said magnetic means includes magnetically active material, said magnetically active material including permanent magnet material with north and south poles aligned substantially parallel to a proximate said linear string segment, said magnetically active material being shaped to substantially enclose on three sides a said portion of coil windings proximate each said linear string segment, one of said linear string segments being disposed proximate a fourth side of each said portion of coil windings, whereby confronting portions of magnetic material provide a preferential magnetic field path through said coil windings and also form a variable reluctance magnetic circuit with each said linear string segment.

6. The magnetic pickup of claim 1 wherein every said two coil portions disposed oppositely and proximate to each string of a musical instrument are opposite sides of a coil of said coil windings, a said coil proximately encompassing a plurality of said linear string segments of a musical instrument.

7. The magnetic pickup of claim 1 wherein each said two coil portions disposed proximate and oppositely to each said linear string segment are opposite sides of a coil of said coil windings, an individual said coil proximately encompassing each individual said linear string segment of a musical instrument.

8. The magnetic pickup of claim 1 further including means for providing variations in said magnetic field within said portions of coil windings and corresponding variations in the signal produced at said coil leads responsive to given vibrational motions of an instrument's said linear string segments.

9. The magnetic pickup of claim 1 further including individual adjustment means for providing variations in said magnetic field within said portions of coil windings proximate each said linear string segment, whereby characteristics of the signal produced at said coil leads responsive to given vibrational motions of each said linear string segment of a musical instrument may be independently modified.

10. The magnetic pickup of claim 1 wherein said magnetic means provides a magnetic field within both said portions of coil oppositely disposed to the axis of each said linear string segment, the north polar direction of said magnetic field within one said disposed portion of coil being the reverse of the north polar direction within said oppositely disposed portion of coil.

11. A magnetic pickup for stringed musical instruments comprised of coil windings of insulative conductive wire and magnetic material, said magnetic material including permanent magnet material, wherein sectors of a coil of said coil windings are disposed oppositely to the axis of each string of a musical instrument and proximate a linear string segment of each said string, said linear string segments containing magnetically active material, each said coil sector being disposed between a proximate said linear string segment on one side and portions of magnetic material on an opposite side, said permanent magnet material having a north to south line of polar orientation substantially parallel to the quiescent axis of said proximate linear string segment and having reversed direction of polarity in said coil sectors which are oppositely disposed to a said linear string segment, portions of said magnetic material being also disposed proximate two end surfaces of each said disposed coil sector, each said disposed coil sector being substantially housed on three sides by magnetic material and disposed proximate a said linear string segment on a fourth side, whereby portions of said magnetic material form two confronting pairs with opposite polarity oppositely disposed proximate each said linear string segment thereby providing a magnetic field to said linear string segments and simultaneously form confronting pairs proximate each end of said oppositely disposed coil sectors thereby providing a magnetic field within said coil sectors, transverse vibrational motion of a said linear string segment in a given direction causing corresponding and simultaneous motion of said magnetic field within both said proximate coil sectors and an electrical impulse generated in one said sector is additive to the electrical impulse simultaneously generated in the oppositely disposed said sector, said magnetic pickup further including means for stably positioning said coil windings and said magnetic material relative to said linear string segments of a musical instrument, and means for electrically connecting the leads of said coil windings to appropriate signal preamplification and amplification devices.

12. The magnetic pickup of claim 11 wherein said coil sectors oppositely disposed to the axis of each said linear string segment and said portions of magnetic material disposed proximate three sides of each said coil sector are substantially disposed above and below the common string plane of a musical instrument, said string plane being conforming and contiguous to the axes of the strings of a musical instrument, whereby said magnetic field provided above said string plane is reversed in polarity from said magnetic field provided below said string plane and transverse string segment motions which are perpendicular to said common string plane produce a relatively strong electrical impulse at said coil leads while transverse string segment motions which are parallel to said common string plane produce a relatively weak signal at said coil leads.

13. The magnetic pickup of claim 11 wherein a said coil sector disposed proximate each said linear string segment of a musical instrument is disposed between permanent magnet material and a said proximate linear string segment, said permanent magnet material having north and south polar surfaces, pole piece portions of said magnetic material being disposed adjacent said north and south polar surfaces and disposed proximate end surfaces of said coil sector, said pickup further including means for providing variations in the distance between surface portions of said pole pieces and proximate said linear string segments, whereby variations in characteristics of the signal produced at said coil leads responsive to given vibrational motions of said linear string segments are provided.

14. The magnetic pickup of claim 11 wherein an individual coil of said coil windings is provided to each string of a musical instrument, each said coil having a protective armature tube, each said linear string segment of said musical instrument being proximately encompassed by a respective said coil and armature tube.

15. Thd magnetic pickup of claim 11 wherein said coil sectors oppositely disposed to the axis of each said linear string segment and said portions of magnetic material disposed proximate three sides of each said coil sector are substantially disposed to each side of and between each said linear string segment along the common string plane of a musical instrument, said common string plane being a plane conforming and contiguous with the axes of the strings of said musical instrument, portions of said magnetic material being disposed between said linear string segments, said coil sectors being disposed between portions of said magnetic material and the proximate said linear string segment, whereby the magnetic field provided to one said coil sector and to one side of a proximate said linear string segment has a reversed polarity to the magnetic field provided within the oppositely disposed said coil sector, transverse vibrational motions of said linear string segments which are parallel to said common string plane causing a relatively strong electrical impulse at said coil leads while transverse string segment motions which are perpendicular to said string plane cause a relatively weak impulse at said coil leads.

* * * * *